US005286156A

United States Patent [19]

Ikenouchi et al.

[11] Patent Number: 5,286,156

[45] Date of Patent: Feb. 15, 1994

[54] APPARATUS FOR TRANSFERRING A MOTOR VEHICLE IN A MULTISTORY PARKING LOT

[75] Inventors: Terumasa Ikenouchi; Niro Okabe; Hirofumi Ishikawa; Haruki Takeuchi, all of Kawasaki, Japan

[73] Assignee: NKK Corporation, Tokyo, Japan

[21] Appl. No.: 932,779

[22] Filed: Aug. 20, 1992

[30] Foreign Application Priority Data

Jun. 19, 1992 [JP] Japan ..... 4-184760

[51] Int. Cl.[5] ..... E04H 6/12

[52] U.S. Cl. ..... 414/256; 414/253

[58] Field of Search ..... 414/253, 255, 256, 259, 414/260, 232, 241

[56] References Cited

U.S. PATENT DOCUMENTS

| | | | |
|---|---|---|---|
| 2,899,087 | 8/1959 | Jacobsen | 414/253 X |
| 2,970,549 | 2/1961 | Volk | 414/253 X |
| 2,985,328 | 5/1958 | Fitch . | |
| 2,988,329 | 6/1961 | Sanders | 414/255 X |
| 2,995,263 | 11/1955 | Fitch . | |
| 3,561,620 | 2/1971 | Willis . | |
| 3,856,160 | 12/1974 | Roth | 414/253 |
| 3,984,012 | 10/1976 | Ennis et al. . | |
| 4,595,332 | 6/1986 | Loomer . | |
| 4,936,730 | 6/1990 | Morioka . | |
| 4,968,208 | 11/1990 | Friberg | 414/256 |
| 4,971,505 | 11/1990 | Sawyer . | |
| 4,971,506 | 11/1990 | Givati | 414/253 X |
| 5,096,363 | 3/1992 | Weinert et al. . | |

FOREIGN PATENT DOCUMENTS

| | | | |
|---|---|---|---|
| 3301595A1 | 7/1984 | Fed. Rep. of Germany . | |
| 51-141181 | 12/1976 | Japan . | |
| 1-284678 | 11/1989 | Japan . | |
| 2-115475 | 4/1990 | Japan . | |
| 0186070 | 7/1990 | Japan | 414/260 |
| WO88/04350 | 6/1988 | PCT Int'l Appl. . | |
| WO89/09866 | 10/1989 | PCT Int'l Appl. . | |
| WO91/12396 | 8/1991 | PCT Int'l Appl. . | |
| 0216562 | 10/1967 | Sweden | 414/259 |
| 574387 | 9/1977 | Switzerland . | |
| 918538 | 2/1963 | United Kingdom . | |
| 920452 | 3/1963 | United Kingdom . | |
| 951958 | 3/1964 | United Kingdom . | |

*Primary Examiner*—Michael S. Huppert
*Assistant Examiner*—James Keenan
*Attorney, Agent, or Firm*—Frishauf, Holtz, Goodman & Woodward

[57] ABSTRACT

An apparatus for transferring a motor vehicle of a multistory parking lot comprises a main carriage which moves under a motor vehicle and carries the motor vehicle, and a first small carriage and a second small carriage, both of which are movably positioned at the forward and rearward portions, respectively, of the main carriage in a direction of movement of the main carriage. Two pairs of swing arms are mounted on each of the first small carriage and the second small carriage, which swing horizontally from the direction of movement of the carriages to a direction substantially perpendicular to the direction of movement of the carriages, and between which front and rear wheels of the motor vehicle are engaged respectively and which raise the front and rear wheels and thereby raise the motor vehicle.

5 Claims, 6 Drawing Sheets

APPARATUS FOR TRANSFERRING A MOTOR VEHICLE IN A MULTISTORY PARKING LOT

CROSS REFERENCE TO RELATED APPARATUS

Ser. No. 07/913,585, filed Jul. 14, 1990, and assigned to the same assignee as the present application, the entire content of which is incorporated herein by reference.

BACKGROUND OF THE INVENTION

1. Field of the Invention

The present invention relates to an apparatus for transferring a motor vehicle in a multistory parking lot, wherein a motor vehicle is transferred from a carriage of a stacker crane to a containment rack.

2. Description of the Related Art

In a multistory parking lot having multistory containment racks, a motor vehicle transfer apparatus is used either to transfer a motor vehicle on a carriage of a stacker crane to a containment rack or to transfer a motor vehicle on a containment rack to a carriage. A conventional motor vehicle transfer apparatus transfers a motor vehicle as follows.

A motor vehicle having been transferred to an entrance of a multistory containment rack is placed on a pallet. The motor vehicle together with the pallet are put on a carriage by slide forks installed on a stacker crane. The carriage with the motor vehicle thereon is aligned with an empty containment rack by moving the stacker crane. The motor vehicle together with the pallet are transferred to the containment rack by operating the slide forks. When a motor vehicle on a containment rack is to be sent off, the motor vehicle together with a pallet are transferred from the containment rack to a carriage by operating slide forks of a stacker crane. Then, the motor vehicle is transferred to an exit by operating the stacker crane.

Japanese Patent Application Laid Open No. 141181/76 discloses a stacker crane for a multistory parking lot which transfers a motor vehicle directly between a carriage of a stacker crane and a containment rack. This prior art stacker crane has a structure as described below.

The carriage of the stacker crane of Japanese Patent Application Laid Open No. 141181/76 moves to-and-fro relative to the containment rack. A plurality of slide forks hold front and rear wheels of a motor vehicle. One of the plurality of slide forks is freely movable to expand and reduce a distance between the slide forks. A motor vehicle is placed on a slat conveyer installed at an entrance of a multistory parking lot by driving the motor vehicle and hand brakes are applied to the motor vehicle. The power supply of the slat conveyer is turned off. A position of the carriage of the stacker crane is aligned with a position of the motor vehicle. The slide forks are expanded toward the outside of the front and rear wheels of the motor vehicle. Then, one of the slide forks is moved in a longitudinal direction of the motor vehicle and in a direction wherein a distance between the slide forks is reduced. The front and rear wheels are held by the slide forks, the outside of the front and rear wheels being put between the slide forks.

On this occasion, one of the slide forks contacts the outside of the wheels. When the other slide fork does not contact the wheels, the motor vehicle is pushed by the slide fork having previously contacted the wheels.

Since the power supply for the slat conveyer is off, the wheels can be put between the slide forks with the smallest force in a direction wherein the slat is pushed. The motor vehicle is put on the carriage by reducing the distance between the slide forks. Also, when the motor vehicle is transferred from the carriage to the containment rack or from the containment rack to the carriage, the transfer of the motor vehicle is carried out by operating the aforementioned slide forks.

In a method for transferring a motor vehicle on a pallet, an empty pallet is required to be returned to an entrance of a multistory parking lot after a motor vehicle is sent off from an exit of the multistory parking lot. Moreover, in preparation for generation of unbalance of the number of motor vehicles coming in and going out, pallet stockers for keeping pallets are necessary. When a difference between the number of motor vehicles coming in and the number of motor vehicles going out is increased, the capacity of the pallet stockers becomes insufficient. In consequence, pallets which cannot be contained in the pallet stockers are required to be contained in containment racks. Therefore, an additional space is required, and wasteful labor is spent for moving only the empty pallets, which gives rise to a high equipment cost and management cost.

The method of Japanese Patent Application Laid Open No. 141181/76 has an advantage in that no pallet is required. This method has a disadvantage, however, in that there are only a few holding points because front and rear wheels are held by putting only the outside of the front and rear wheels between slide forks, and therefore, a motor vehicle is liable to move to-and-fro during movement of a stacker crane, which makes the motor vehicle unstable. Particularly, in the case of a motor vehicle in which hand brakes are applied, since the wheels do not rotate when the wheels are put between the slide forks, slip or sliding between the slide forks and the wheels is produced, which leads to abrasion of the tires of the wheels.

In addition, when a motor vehicle contained in a containment rack is sent off, since there is no apparatus such as a slat conveyer for freely moving the motor vehicle, the tires of the wheels slip on the containment rack, which abrades the tires.

SUMMARY OF THE INVENTION

It is an object of the present invention to provide an apparatus for transferring a motor vehicle in a multistory parking lot wherein a motor vehicle can be precisely transferred from a carriage of a stacker crane to a containment rack or from the containment rack to the carriage without damaging tires of the wheels of the motor vehicle when the motor vehicle approaches an entrance of the multistory parking lot and is sent off from the exit of the multistory parking lot.

According to the present invention, an apparatus for transferring a motor vehicle in a multistory parking lot comprises:

a main carriage which moves under a motor vehicle and carries the motor vehicle;

a first small carriage and a second small carriage, both of which are movably positioned at forward and rearward positions on said main carriage in a direction of movement of the main carriage; and two pairs of swing arms mounted on each of said first small carriage and said second small carriage, and which swing horizontally from a direction of movement of said main carriage and to a position substantially perpendicular to the direction of movement of said main carriage and between which front and rear wheels of the motor vehicle are arranged respectively, and which raise the front and rear wheels of the motor vehicle.

The above objects and other objects and advantages of the present invention will become apparent from the detailed description to follow, taken in conjunction with the appended drawings.

DETAILED DESCRIPTION

Figure 1:
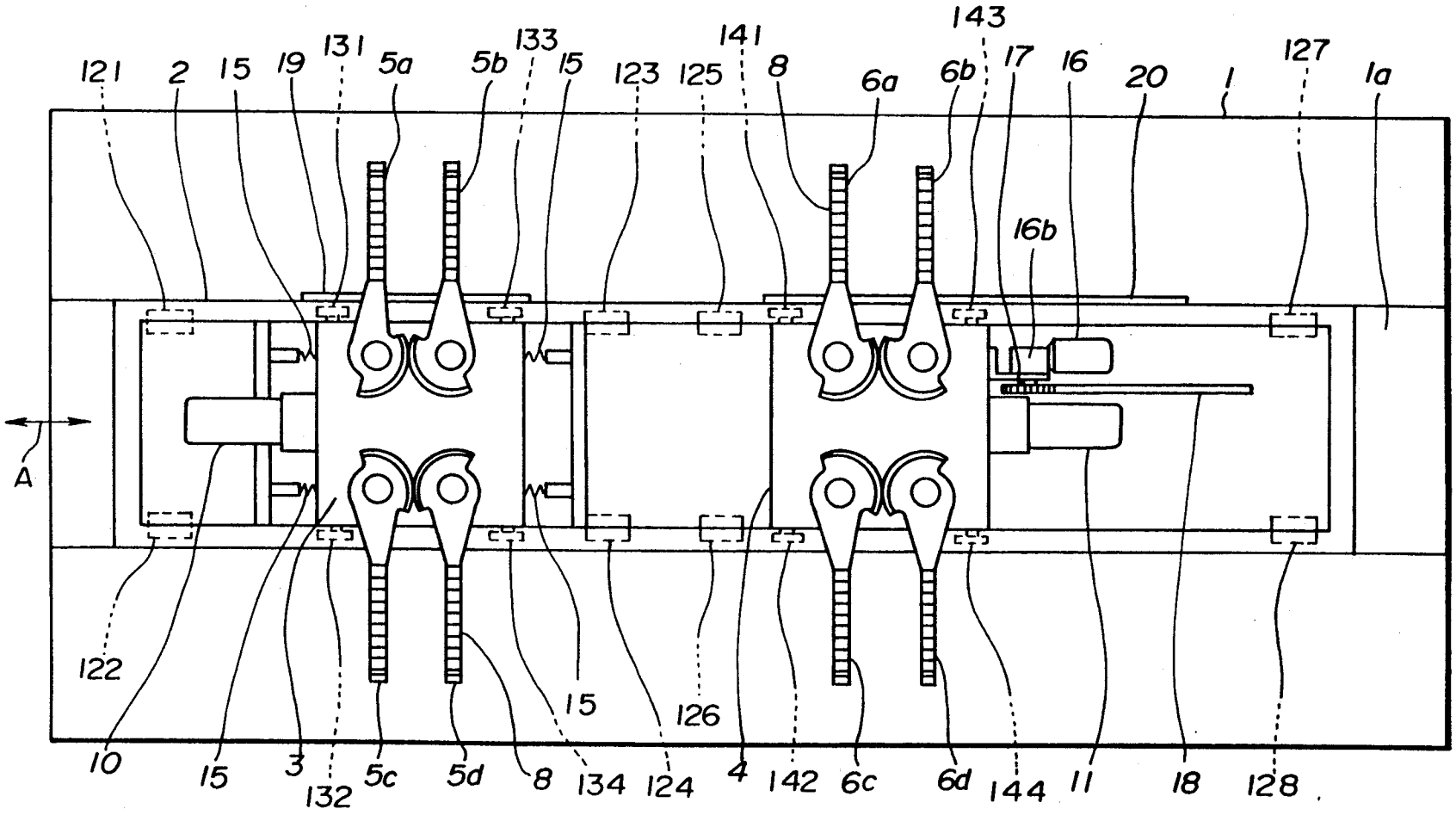
FIG. 1 is a top plan view illustrating an apparatus for transferring a motor vehicle of a multistory parking lot of the present invention.

An example of an apparatus for transferring a motor vehicle in a multistory parking lot of the present invention will now be described. In FIG. 1, the apparatus for transferring a motor vehicle comprises a main carriage 2 positioned freely movably in a concave path 1*a* at the center of a mother carriage 1 of a stacker crane. Small carriages 3 and 4 are respectively freely movably positioned at the forward end of and at the rear end of the main carriage 2 in a direction of movement of the main carriage 2. Two pairs of swing arms 5*a* to 5*d* are mounted on small carriage 3, and two pairs of swing arms 6*a* to 6*d* are mounted on small carriage 4. Each of the swing arms are swingable horizontally from the direction of movement of the main carriage 2 to a direction substantially perpendicular to the direction of movement of the main carriage 2. Front and rear wheels of the motor vehicle are arranged between pair of swing arms which raise the front and rear wheels, as described below.

As shown in FIG. 1, the main carriage 2 is movably supported on the mother carriage 1 by means of rollers or rotatable wheels 121–128, and main carriage 2 is thus movable in the direction of the arrow A. The small carriage 3 is movably mounted to the main carriage 2 by means of rollers or rotatable wheels 131–134, so that the small carriage is movable in the direction of the arrow A relative to the main carriage 2. Similarly, small carriage 4 is mounted to the main carriage 2 by means of rollers or rotatable wheels 141–144 so that small carriage 4 is also movable in the direction of arrow A relative to main carriage 2.

Figure 2:
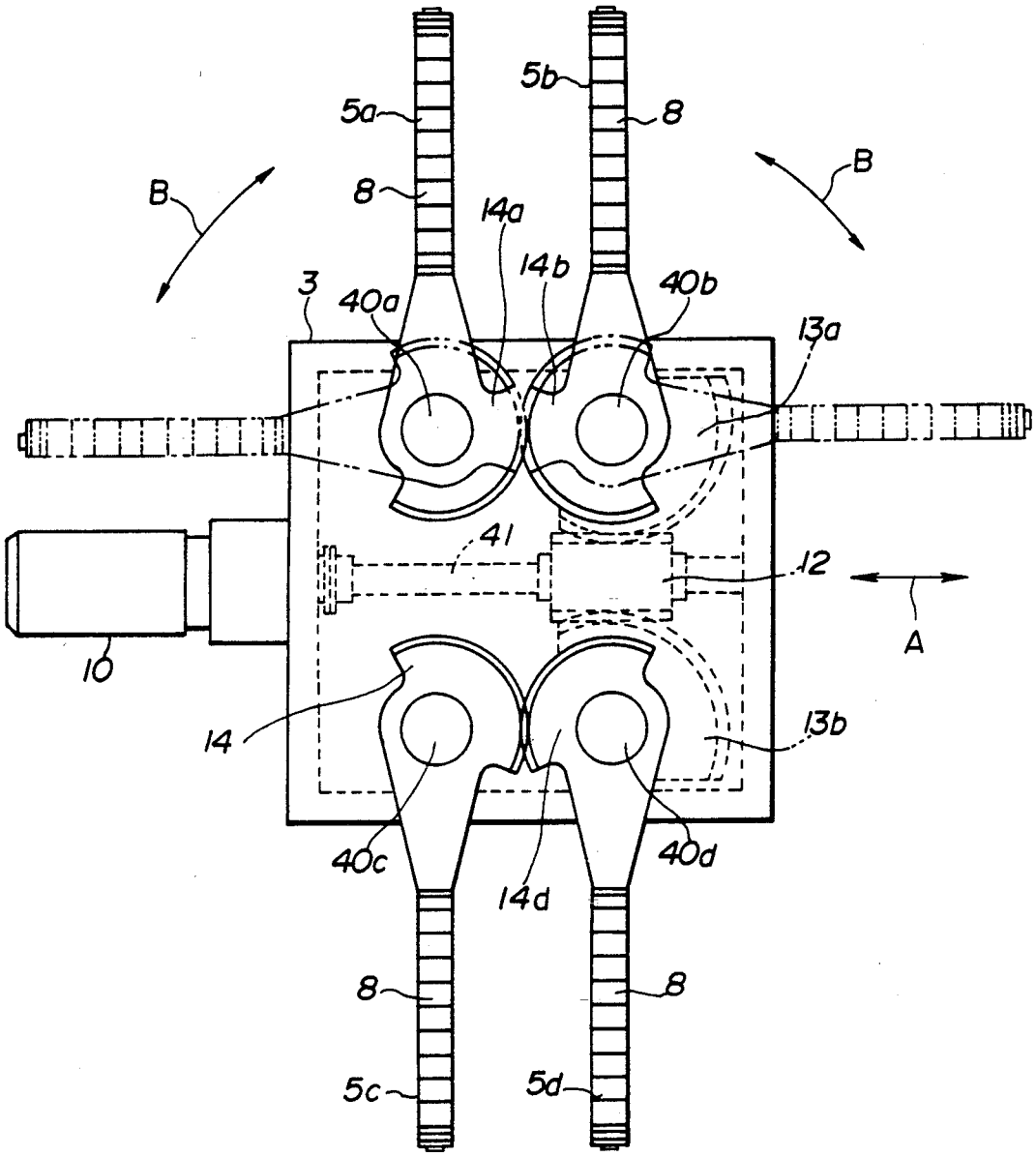
FIG. 2 is a top plan view illustrating a small carriage and swing arms of the apparatus for transferring a motor vehicle of the present invention.

As shown in FIG. 2, fan-shaped spur gears 14*a*, 14*b*, 14*c* and 14*d* are provided at the rear ends of swing arms 5*a* to 5*d*, respectively. The rear or innermost ends of the swing arms 5*a* to 5*d* are fixed to upper portions of respective rotating shafts 40*a*, 40*b*, 40*c* and 40*d*. The shafts 40*a*–40*d* are each rotatably mounted on the small carriage 3 through bores, bearings, or the like therein. The spur gears 14*a* and 14*b* are positioned so that they can engage with each other, and the spur gears 14*c* and 14*d* are positioned so that they can engage with each other as shown in FIG. 2. Worm gears 13*a* and 13*b* are mounted on the lower portion of rotating shafts 40*b* and 40*d*, respectively, and engage with a worm 12 positioned between both of the worm gears 13*a* and 13*b*. The worm 12 is connected to be rotatably driven by a swing motor 10 via shaft 41. As shown in FIG. 1, swing arms 6*a*, 6*b*, 6*c* and 6*d*, pairs of fan-shaped spur gears, a pair of worm gears, a worm, a shaft and a swing motor 11 are mounted on the other small carriage 4 in the same manner as described above with respect to small carriage 3.

Since the swing arms of both of the small carriages 3 and 4 operate in the same way, only the operation of the swing arms 5*a* to 5*d* of the small carriage 3 will now be described. Since the worm gear 13*a* rotates counterclockwise and the shaft 40*b* thereby rotates counterclockwise when the swing motor 10 is rotated positively, the swing arm 5*b* rotates counterclockwise from its position in a direction of movement of the carriage 2 (broken-line position in FIG. 2) whereas the swing arm 5*a* rotates clockwise from its broken-line position in the direction of movement of the carriage 2 since the fan-shaped spur gears 14*b* and 14*a* are engaged with each other. That is, the swing arms 5*a* and 5*b* rotate in a direction such that wheels of the motor vehicle are put between the swing arms 5*a* and 5*b* when the swing arms are moved to their outward position as shown by solid lines in FIG. 2. On this occasion, the turning angle of the swing arm is about 90°. Conversely, when the swing motor 10 is reversely rotated, the swing arms 5*a* and 5*b* rotate in a direction such that those arms open fanwise to positions (positions on a two-dot chain line) directed in the direction of movement (direction of arrow A) of the carriage 2. That is, the swing arms 5*a* and 5*b* rotate in a direction such that they are caused to leave or release the tires of the wheels of the motor vehicle which were previously put between the swing arms 5*a* and 5*b*.

Figure 3:
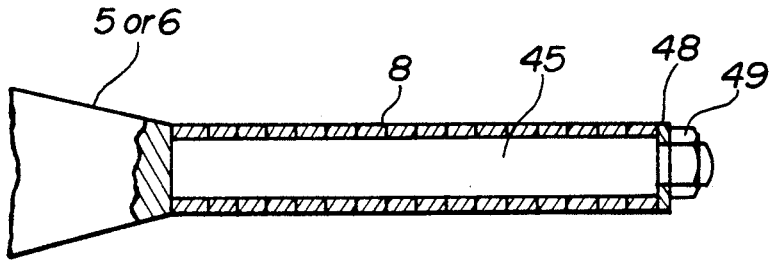
FIG. 3 is a sectional view showing an example of a wheel holding portion of a swing arm according to the present invention.
Figure 4:
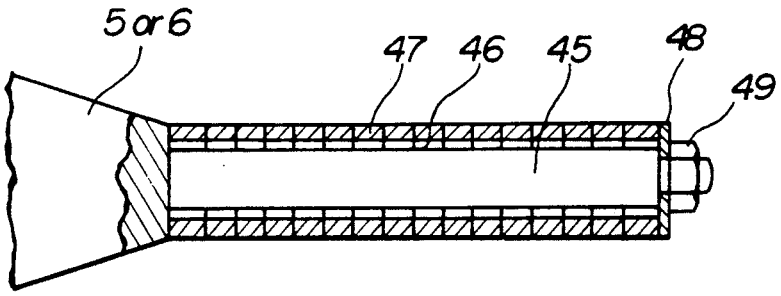
FIG. 4 is a sectional view showing another example of a wheel holding portion of a swing arm according to the present invention.

Concerning the tire holding portion of the swing arms 5*a* to 5*d* and 6*a* to 6*d* for a motor vehicle, each of the holding portions is desired to have a structure such that it can rotate around the axis of each of the swing arms so that tires of wheels of a motor vehicle cannot be damaged by abrasion by a pair of swing arms. FIG. 3 shows one of the examples of the holding portions wherein a plurality of ring-shaped sintered oil retaining bearings 8 are fitted loosely and rotatably to the arm axes 45 of each of the swing arms. FIG. 4 shows another example wherein a plurality of rings 47 are rotatably fitted to the arm axes 45 of each of the swing arms via bearings 46. An end plate 48 and nut 49 are fitted to the end of each of the arm axes 45 to prevent the sintered oil retaining bearings 8 (FIG. 3) or the rings 47 and the bearings 46 (FIG. 4) from becoming loose from the shafts or arm axes 45.

As shown in FIG. 1, front and rear ends of the small carriage 3 are connected to the main carriage 2 via springs 15 so that a position of the small carriage 3 can be determined. When the wheels of the motor vehicle are put between the swing arms and are held or gripped by the swing arms, a difference between a distance between the front axle and the rear axle of the motor vehicle and a distance between the center between a pair of front swing arms and the center between a pair of rear swing arms can be absorbed by the springs 15 which will permit resilient movement of small carriage 3 relative to main carriage 2 in the direction of arrow A. A distance control motor 16 which has a reduction gear 16*b* and controls the distance (the distance between the center between a pair of swing arms 5*a* and 5*b* and the center between a pair of swing arms 6*a* and 6*b* in FIG. 1) between the center between the pair of front swing arms and the center between the pair of rear swing arms is mounted on the other small carriage 4. A pinion 17 is mounted on an output shaft of the above-described reduction gear 16*b* and engages with a rack gear 18 mounted on the main carriage 2. Therefore, the distance between the center between a pair of front swing arms and the center between a pair of rear swing arms can be adapted to the distance between the front axle and the rear axle of the motor vehicle by positively or reversely rotating the distance control motor 16. That is, motor vehicles having various distances between the front axle and the rear axle can be handled by the system of the present invention.

Figure 8:
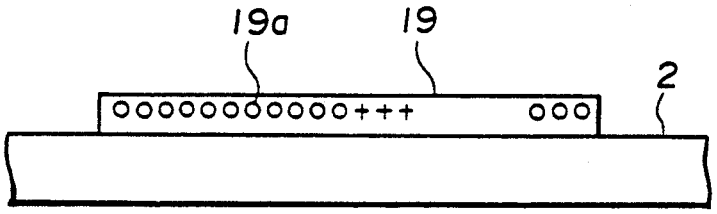
FIG. 8 is a schematic illustration showing an arrangement of the optical sensors, which is taken in the direction of the arrows along line 8—8 of FIG. 7.

A position detection sensor 19 for detecting a position of front wheels (or rear wheels) of a motor vehicle are mounted on the main carriage 2, adjacent to the small carriage 3. An area sensor 20 for detecting a position of rear wheels (or front wheels) of a motor vehicle is mounted on the main carriage, adjacent to the small carriage 4. A sensor having a long and narrow rectangular shape wherein a number of reflecting optical sensors 19*a* having a light projecting section and a light receiving section are arranged at small intervals (for example, at intervals of 10 mm) is used for the position detection sensor 19 and the area sensor 20 as shown in FIG. 8.

Figure 7:
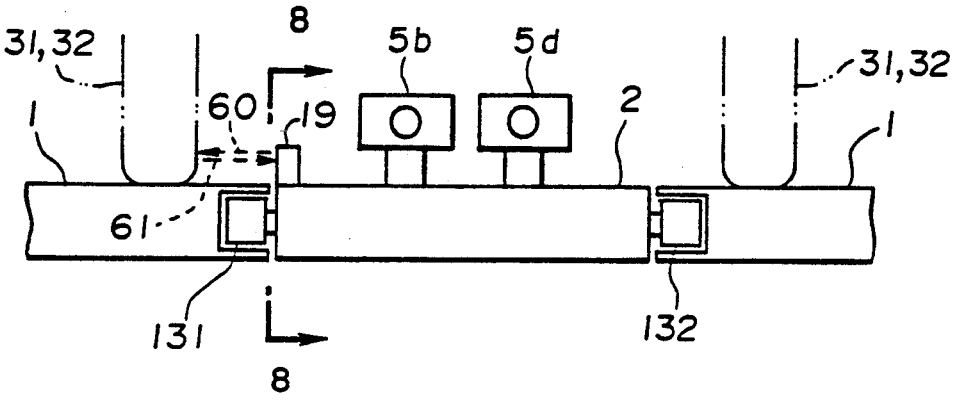
FIG. 7 is a schematic illustration showing the relationship between positions of optical sensors and positions of tires of wheels of a motor vehicle.

As shown in FIG. 7, the above optical sensors 19 (or 20) are arranged as if they projected their light in the direction of the wheels 31, 32 of the motor vehicle carried on the mother carriage 1. Light 60 projected from the light projecting section is reflected by the wheels 31, 32 and reflected light is received by the light receiving section. That is, the optical sensors detect the presence of the tires in their forward position by means of their light receiving section which receives the reflected light. Since a number of optical sensors 19*a* are arranged in a width direction of each of the wheels at small intervals, the optical sensors corresponding to the width of each of the tires of the wheels positioned at a level of the optical sensors can receive the reflected light from the tires of the wheels. The signal from the optical sensor 19*a* having received the reflected light is sent to the control unit 22. The control unit 22 finds the width of each of the tires positioned at the level of the optical sensor 19*a* on the basis of the position of the optical sensor 19*a* having sent the signal of the received light and the number of them and calculates the position of the center of each of the wheels on the basis of the width of each of the tires and the position of the optical sensor 19*a* and its position.

Figure 5:
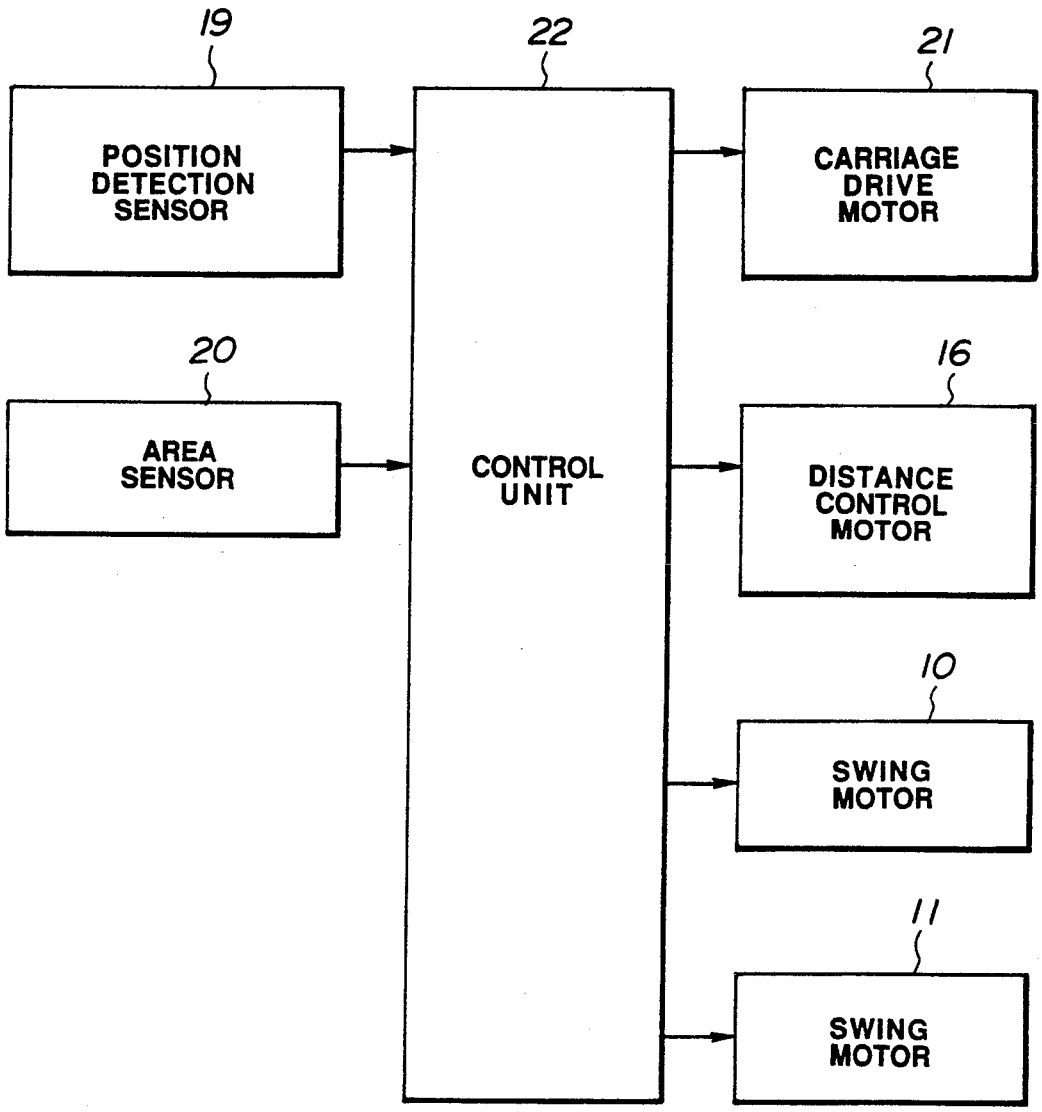
FIG. 5 is a block diagram showing a control unit of the apparatus for transferring a motor vehicle of the present invention.

The transfer steps of the apparatus for transferring a motor vehicle according to the present invention will now be described with specific reference to FIGS. 5 and 6.

Figure 6A:
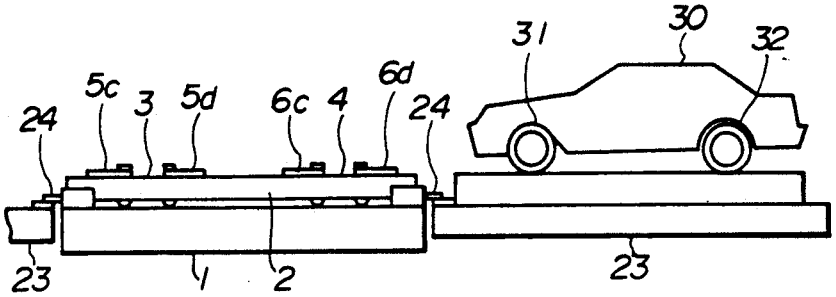
FIGS. 6*a*, 6*b*, 6*c* and 6*d* are schematic illustrations showing the steps of transferring a motor vehicle by using the apparatus of the present invention.

Initially, the swing arms 5*a* to 5*d* and 6*a* to 6*b* are arranged in parallel with the direction of movement of the main carriage 2 (in parallel to arrow A in FIG. 2). As shown in FIG. 6*a*, the mother carriage 1 of the stacker crane having the main carriage 2 thereon is moved to a position of a containment rack 23 where a motor vehicle 30 to be transferred is kept. The mother carriage 1 is connected to the containment rack 23 by extending securing pins 24 on both sides of the carriage 1 to both sides of the containment rack 23, whereby the position of the carriage 1 is determined.

Figure 6B:
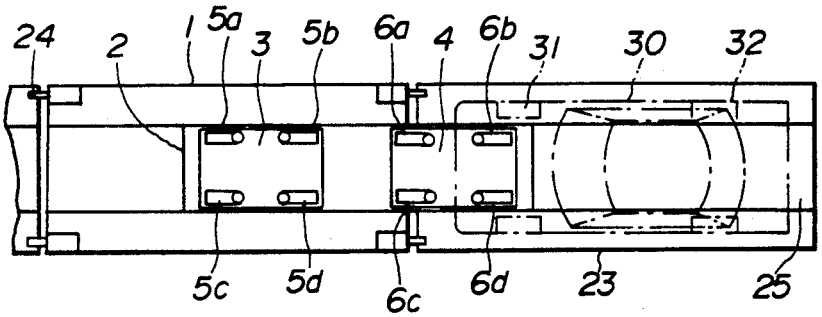
Figure 6C:
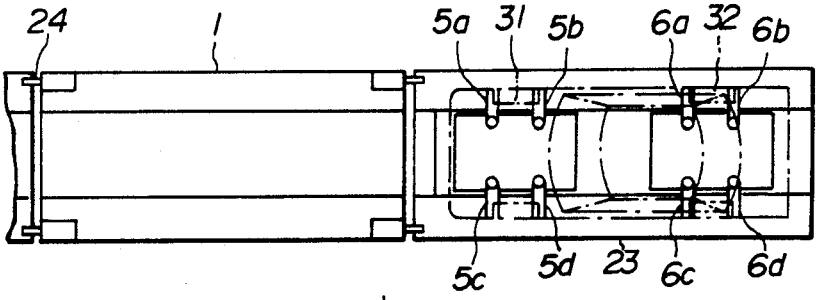

After the position of the mother carriage 1 has been determined, the main carriage 2 is caused to move by sending a signal from a control unit 22 to the carriage drive motor 21 and is caused to enter the carriage path 25 under the motor vehicle 30 on the containment rack 23 as shown in FIG. 6*b*. When the position detection sensor 19 detects the front wheels 31 of the motor vehicle, a detection signal is sent to the control unit 22. A stop signal is sent to the carriage drive motor 21 and the main carriage 2 is stopped. Then, a position of the rear wheels of the motor vehicle 30 is detected by the area sensor 20 and a signal of the detection of the rear wheels is sent to the control unit 22. The control unit 22 calculates the number of rotations of the distance control motor 16 required for moving the rear small carriage 4 to cause the distance between the center between the front swing arms and the center between the rear swing arms to be the same as the distance between the axes of the front wheels and the shaft of the rear wheels of the motor vehicle on the basis of the above signal and sends a signal corresponding to the number of rotations to the distance control motor 16. The distance control motor 16 rotates to move the small carriage 4 by a predetermined distance by means of the pinion 17 and the rack 18 (FIG. 1). Then, a signal is sent to swing motors 10 and 11 to rotate the swing motors 10 and 11. When the swing motors rotate, the swing arms 5*a* to 5*d* and 6*a* to 6*d* swing outwardly as shown in FIG. 6*c*. As a result of the above swinging of the swing arms 5*a* to 5*d* and 6*a* to 6*d*, the righthand front wheel 31 and the lefthand front wheel 31 of the motor vehicle 30 are engaged between the swing arms 5*a* and 5*b* and between the swing arms 5*c* and 5*d* respectively, and the righthand rear wheel 32 and lefthand rear wheel 32 of the motor vehicle are engaged between the swing arms 6*a* and 6*b* and between the swing arms 6*c* and 6*d* respectively.

Since the swing arms 5*a* to 5*d* and 6*a* to 6*d* are positioned at a lower height than a position of the horizontal diameter of each of the front wheels 31 and the rear wheels 32, and since the front wheels 31 and the rear wheels 32 are engaged between the swing arms 5*a* to 5*d* and 6*a* to 6*d* respectively, the motor vehicle 30 is raised from the containment rack 23 by the swing arms and is held on the main carriage 2, when the swing arms 5*a* to 5*d* and 6*a* to 6*d* swing over an angle of about 90° to press against the respective wheels. Since a plurality of rings 8 or 47 are freely rotatably mounted on the arm shafts 45 of the swing arms 5*a* to 5*d* and 6*a* to 6*d*, when the swing arms 5*a* to 5*d* and 6*a* to 6*d* swing and contact the tires of the front and rear wheels, rings 8 or 47 can rotate and absorb a difference between a speed of the swing arms at contact points (contact points where the holding portions of the swing arms contact the tires of the wheels) near the rotation axes (40*a*, etc.) and a speed of the swing arms at contact points far from the rotation axes (40*a*, etc.) due to their rotation. In consequence, the tires of the wheels can be raised smoothly by pressure from the paired swing arms without damaging the tires. Also, since the resistance of the tires against the swing arms is decreased, the capacity (i.e., output power) of the swing motors 10 and 11 can be decreased.

Since the front and rear ends of the small carriage 3 are connected to the carriage 2 via the springs 15, when the front wheels 31 and the rear wheels 32 are engaged between the swing arms 5*a* to 5*d* and 6*a* to 6*d* respectively, the small carriage 3 moves in response to a position of the front wheels. As a result, the positions of the small carriages 3 and 4 are automatically adapted to the center of each of the shafts or axes of the front wheels and the rear wheels of the motor vehicle.

Figure 6D:
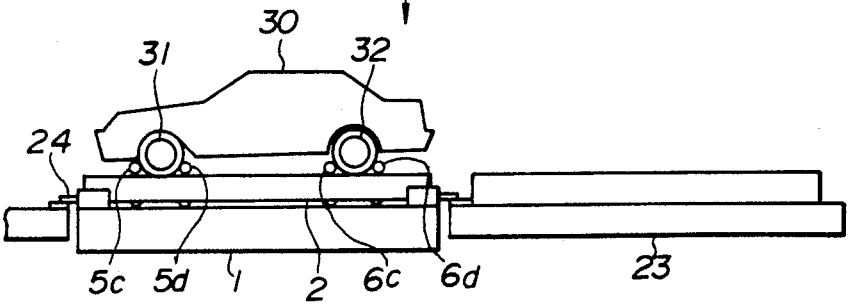

Then, a running motion signal is sent from the control unit 22 to the carriage drive motor 21. The main carriage 2 moves to a predetermined position on the mother carriage 1 as shown in FIG. 6*d* and stops there. The securing pins 24 of the mother carriage 1 of the stacker crane and of the containment rack 23 are pulled out. The stacker crane having the mother carriage 1 with the motor vehicle 30 thereon moves to the exit. After the carriage 1 has been adapted to the position of a transfer table positioned at the exit, the main carriage 2 moves to a predetermined position of the transfer table and stops there. The swing arms 5*a* to 5*d* and 6*a* to 6*d* open fanwise to release the wheels, and the front and rear wheels of the motor vehicle are lowered onto the transfer table. A driver enters the motor vehicle and sends off the motor vehicle from the multistory parking lot by driving the motor vehicle.

The case where the motor vehicle kept in the containment rack is sent off from the multistory parking lot was described above. When the motor vehicle is to be kept in the containment rack, the steps reverse to the above-described steps can be taken. In the above example, the case where the position of the rear wheels is detected by the area sensor 20 and the rear small carriage 4 is moved is described. However, the rear small carriage 4 can be moved by inputting types of motor vehicles into the control unit 22 by means of a keyboard, mark sheets and the like, and the control unit calculates distances between shafts or axles of wheels of the motor vehicles.

According to the present invention, the following improved effects can be obtained.

1. A motor vehicle can be precisely transferred in safety from a carriage of a stacker crane to a containment rack or from a containment rack to a carriage of a stacker crane;
2. Since no pallet is required, construction costs and maintenance costs of a multistory parking lot can be decreased;
3. Since a plurality of rings are freely rotatably attached to the swing arm shafts, tires of the wheels of a motor vehicle cannot be damaged, and since the resistance force of the tires against the swing arms is small, a small capacity (low power) swing motor can be used;
4. Since the apparatus for transferring a motor vehicle has a structure such that swing arms are mounted on small carriages and a motor vehicle can be raised by swinging of the swing arms, with the tires of the wheels of the motor vehicle being engaged between the swing arms, the height of the apparatus can be small. In consequence, the height of the containment rack can be decreased, whereby more motor vehicles than the conventional parking lot can be kept in the same vertical space; and
5. Since each of the front wheels and the rear wheels of a motor vehicle are engaged between swing arms and are held in a raised position by the swing arms in the apparatus of the present invention whereas the outside of the front wheels and the rear wheels are put between slide forks in the conventional apparatus, the motor vehicle can be moved by a stacker crane more exactly and more safely than with the conventional apparatus.

While the invention has been described above with respect to specific apparatus, it should be clear that various modifications and alterations can be made thereto within the scope of the invention as defined in the appended claims.

What is claimed is:

1. An apparatus for transferring a motor vehicle in a multistory parking lot, comprising:

a main carriage which is movable to a position under a motor vehicle, and which carries the motor vehicle;

a first small carriage and a second small carriage, both of which are movably positioned at forward and rearward positions, respectively, on said main carriage, and which are movable relative to said main carriage in a direction of movement of said main carriage;

two pairs of rotating shafts mounted on each of said first small carriage and said second small carriage;

two pairs of swing arms mounted on respective said pairs of said rotating shafts on each of said first small carriage and said second small carriage, said two pairs of swing arms of each of said small carriages being swingable horizontally from a first position in a direction of movement of said main carriage to a second position substantially perpendicular to said direction of movement of said main carriage, and between which front and rear wheels of the motor vehicle are engaged respectively when said swing arms are in said second position, said swing arms in said second position pressing against the respective wheels to thereby raise the front and rear wheels of the motor vehicle;

two pairs of fan-shaped spur gears mounted on respective said pairs of said rotating shafts of each said carriage, with the fan-shaped spur gears of each pair coacting with each other so as to simultaneously rotate each corresponding pair of swing arms oppositely relative to each other; and driving means, associated with each said carriage, for rotatably driving said rotating shafts, each said driving means including one worm, and two worm gears mounted on each of said small carriages, one said worm gear being mounted on one rotating shaft of a pair of rotating shafts, and the other said worm gear being mounted on one rotating shaft of the other pair of rotating shafts of each small carriage, and the worm on each small carriage being engaged with said worm gears of the same small carriage so as to provide simultaneous rotation of said two pairs of swing arms of each small carriage upon rotation of the respective said worm.

2. The apparatus of claim 1, wherein said swing arms each include an arm shaft and holding means for engaging and holding a motor vehicle wheel, said holding means being freely rotatable around said arm shafts.

3. The apparatus of claim 1, further comprising:

means for moving at least one of said first small carriage and said second small carriage relative to said main carriage in a direction of movement of said main carriage; and means for adjusting a distance between a center of a pair of front ones of said swing arms and a center of a pair of rear ones of said swing arms to correspond to a distance between a shaft of front motor vehicle wheels and a shaft of rear motor vehicle wheels.

4. The apparatus of claim 3, wherein said swing arms each include an arm shaft and holding means for engaging and holding a motor vehicle wheel, said holding means being freely rotatable around said arm shafts.

5. The apparatus of claim 1, further comprising a mother carriage on which said main carriage is movably mounted, said main carriage being movable relative to said mother carriage.

* * * * *